US007223141B1

(12) United States Patent
Shiue

(10) Patent No.: US 7,223,141 B1
(45) Date of Patent: May 29, 2007

(54) STRETCHABLE FOOT POCKET OF FIN

(75) Inventor: Chih-Cheng Shiue, Escondido, CA (US)

(73) Assignee: QDS Injection Molding LLC, Escondido, CA (US)

( * ) Notice: Subject to any disclaimer, the term of this patent is extended or adjusted under 35 U.S.C. 154(b) by 0 days.

(21) Appl. No.: 11/373,959

(22) Filed: Mar. 14, 2006

(51) Int. Cl.
*A63B 31/08* (2006.01)

(52) U.S. Cl. ..... 441/64; D21/806

(58) Field of Classification Search ..... 441/64; D21/806
See application file for complete search history.

(56) References Cited

U.S. PATENT DOCUMENTS 1,607,857 A * 11/1926 Zukal ..... 441/64
3,042,943 A * 7/1962 Katehis ..... 441/64
5,511,999 A * 4/1996 Cochran et al. ..... 441/64

* cited by examiner

*Primary Examiner*—Jesús D. Sotelo
(74) *Attorney, Agent, or Firm*—Troxell Law Office, PLLC

(57) ABSTRACT

An integral pocket of fin having a forward blade is disclosed. In one embodiment, the foot pocket includes a vamp, an outside counter, and a plurality of stretchable connection members interconnected the vamp and the outside counter. The connection members are adapted to stretch when the human foot is inserted in the foot pocket so as to fit different individuals with various foot sizes.

8 Claims, 5 Drawing Sheets

STRETCHABLE FOOT POCKET OF FIN

BACKGROUND OF THE INVENTION

1. Field of Invention

The present invention relates to fins for diving and more particularly to such a fin having a stretchable foot pocket so as to fit different individuals with various foot sizes.

2. Related Art

A conventional fin comprises a foot pocket for covering the human foot, and a blade extended forward from the foot pocket. A diver may put his or her feet in the foot pockets. In use, the diver may exert a force to vibrate the blades for propelling forward.

Conventionally, the foot pocket of a fin can be classified as either a pocket type (see FIG. 1) or a well type without an outside counter (see FIG. 2). For well type foot pocket, a strap A is provided around the heel and a snapping type fastener B is provided at a rear portion of the foot pocket for fastening the foot in the foot pocket by securing to the strap A.

One advantage of a fin having a pocket type foot pocket is that a person can easily find a fit fin to put his or her foot in the foot pocket. However, its disadvantage is that a number of fins with different sizes are required to be commercially available such that different individuals with various foot sizes may have a chance to select a pair of fit fins. It is often that a person wearing fins may feel discomfort if the foot pockets are too tight or too loose, resulting in an increased difficulty of moving.

One advantage of a fin having a well type foot pocket is that it is adapted to fit different individuals with various foot sizes. However, its disadvantage is that the fastening of the foot by the strap and fastener may become loose after a short period of time. Thus, the wearer may feel discomfort. Further, it may hook a foreign object, resulting in an increased difficulty of moving.

Typically, commercially available fins are formed of plastic material and have limited flexibility and resilience. Thus, continuing improvements in the exploitation of a fin having a stretchable foot pocket are constantly being sought.

SUMMARY OF THE INVENTION

It is therefore an object of the present invention to provide a fin comprising an integrally formed foot pocket including a front vamp for receiving a front portion of the human foot, an outside counter for receiving a rear portion of the human foot, and a plurality of stretchable connection members interconnected the vamp and the outside counter; and a blade extended forward from the vamp; wherein the connection members are adapted to stretch when the human foot is inserted in the foot pocket so as to fit different individuals with various foot sizes.

In one aspect of the present invention the connection members, the vamp, and the outside counter are formed of the same material.

In another aspect of the present invention the connection members have sufficient thickness and width so as to be durable even being subjected to repeated stretching.

In yet another aspect of the present invention some of the connection members are formed at both sides of the foot pocket for interconnecting the vamp and the outside counter and each of the remaining at least one of connection members is formed between a sole and the outside counter for interconnection.

In a further aspect of the present invention some of the connection members are formed at both sides of the foot pocket for interconnecting the vamp and the outside counter, each of the remaining at least one of connection members is formed between the sole and the outside counter for interconnection, and each of the connection members formed either at both sides of the foot pocket or at the sole comprises a plurality of components.

The above and other objects, features and advantages of the present invention will become apparent from the following detailed description taken with the accompanying drawings.

DETAILED DESCRIPTION OF THE INVENTION

Figure 1:
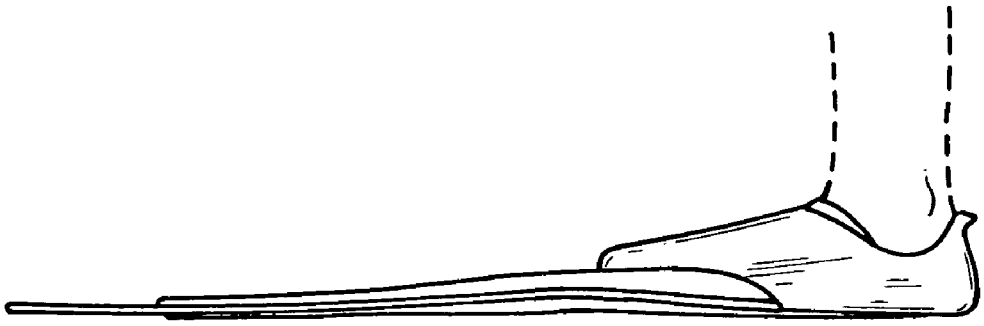
FIG. 1 (PRIOR ART)
FIG. 1 is a side elevational view of a conventional fin having a pocket type foot pocket.
Figure 2:
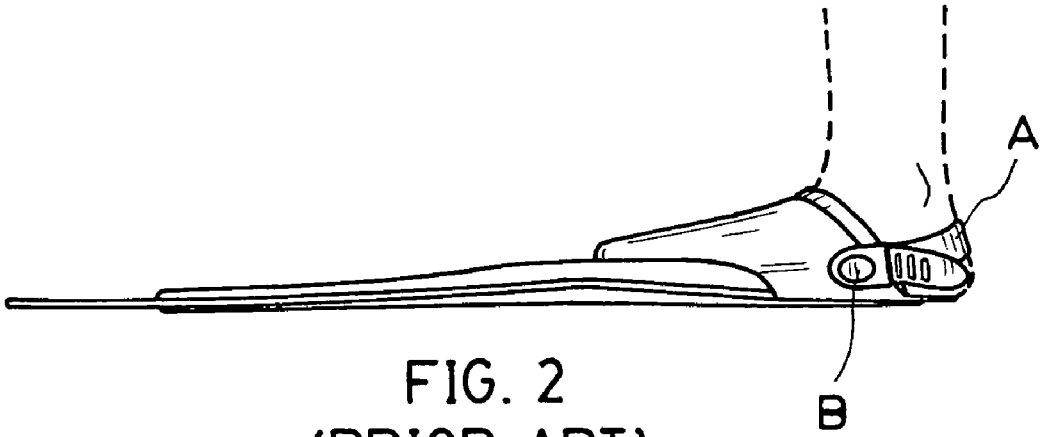
FIG. 2 (PRIOR ART)
FIG. 2 is a side elevational view of another conventional fin having a well type foot pocket.
Figure 3:
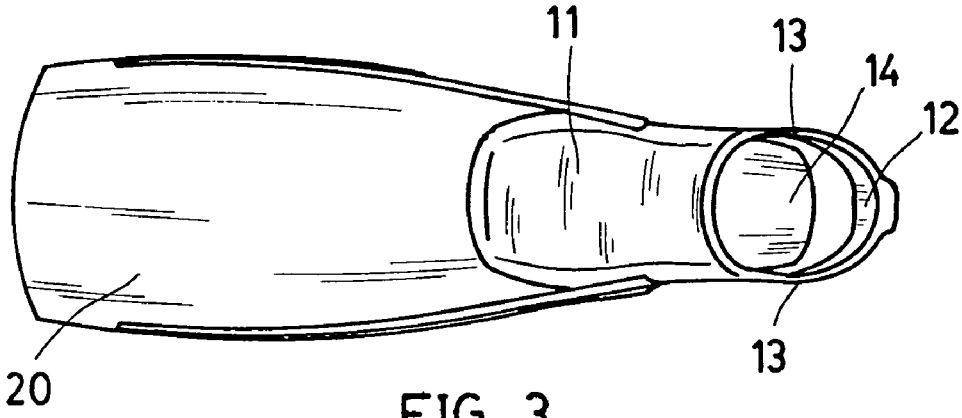
FIG. 3 is a side elevational view of a first preferred embodiment of fin according to the invention.
Figure 4:
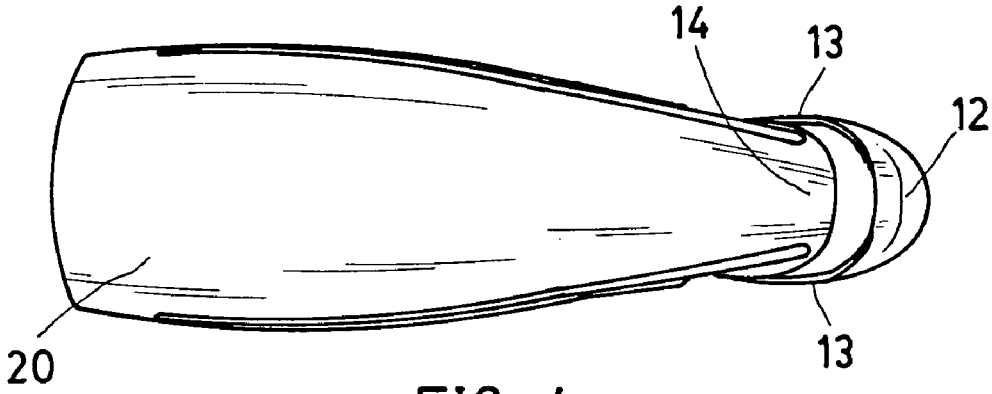
FIG. 4 is a top view of FIG. 3.
Figure 5:
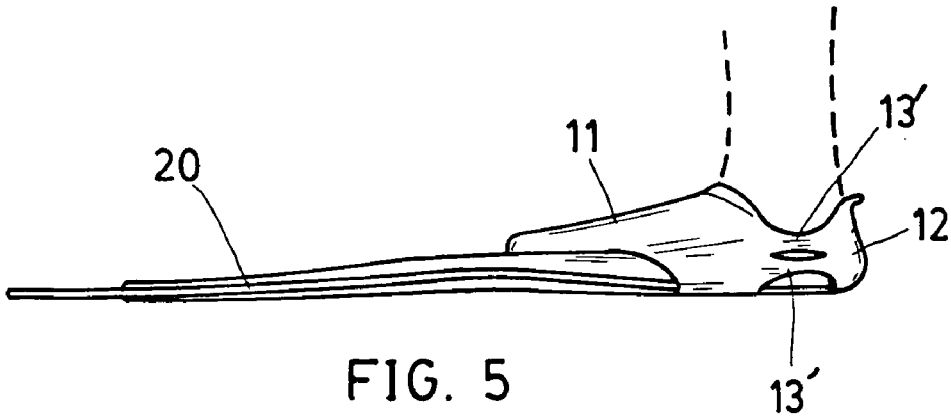
FIG. 5 is a bottom view of FIG. 3.

Referring to FIGS. 3 to 5, a fin in accordance with a first preferred embodiment of the invention comprises a foot pocket 10 including a vamp 11, an outside counter 12, three connection members (e.g., left, right, and bottom connection members) 13 interconnected the vamp 11 and the outside counter 12, and a sole 14. The foot pocket 10 is formed integrally by injection molding. Also, the connection members 13 are made stretchable. Further, the connection members 13, the vamp 11, and the outside counter 12 are formed of the same material. Furthermore, the connection members 13 have sufficient thickness and width so as to be durable even being subjected to repeated stretching.

The fin further comprises a blade 20 extended forward from bottom and two sides of the vamp 11. The blade 20 may have a shape other than one as shown in FIGS. 3 to 5 in other embodiments.

Figure 6:
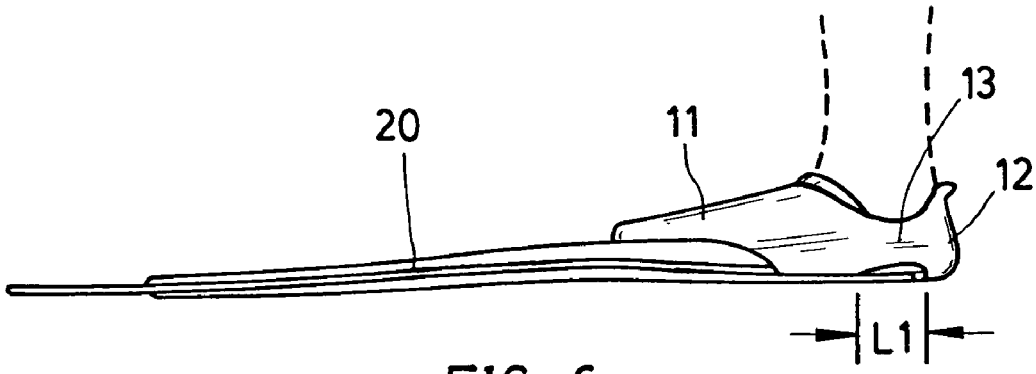
FIG. 6 is a view similar to FIG. 3 showing the connection members being stretched slightly after inserting the foot of one person in the foot pocket.
Figure 7:
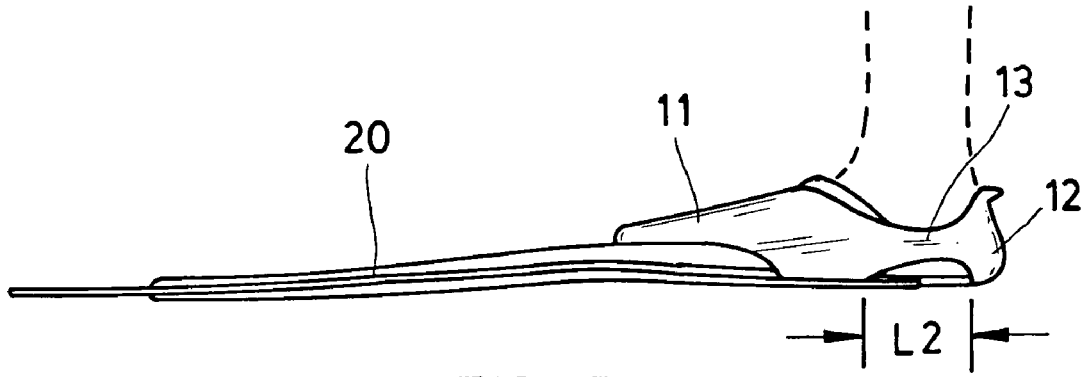
FIG. 7 is a view similar to FIG. 3 showing the connection members being stretched significantly after inserting the foot of another person in the foot pocket.

Referring to FIG. 6, the foot pocket 10 is slightly stretched due to the stretch of the connection members 13 (as indicated by length L1) after inserting the foot of one person therein. Referring to FIG. 7, the foot pocket 10 is significantly stretched due to the stretch of the connection members 13 (as indicated by length L2 which is longer than L1) after inserting the foot of another person therein. The provision of the connection members 13 thus is able to enable the fin to fit different individuals with various foot sizes.

Figure 8:
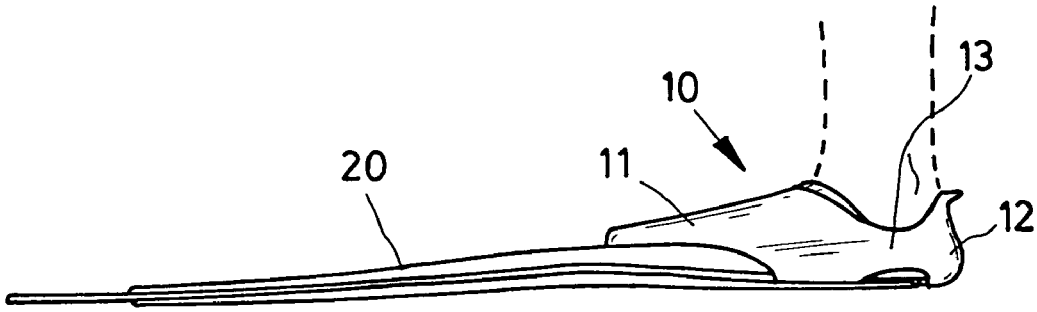
FIG. 8 is a top view of a second preferred embodiment of fin according to the invention.
Figure 9:
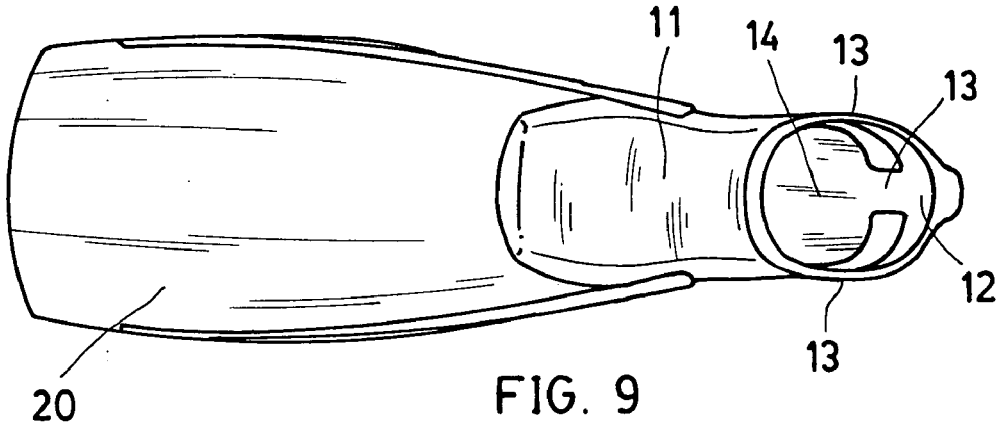
FIG. 9 is a bottom view of FIG. 8.

Referring to FIGS. 8 and 9, a second preferred embodiment of the invention is shown. The second preferred embodiment substantially has same structure as the first preferred embodiment. The characteristics of the second preferred embodiment are detailed below. Two connection members (e.g., left and right connection members) 13 are interconnected the vamp 11 and the outside counter 12 but no connection member being formed between the sole 14 and outside counter 12.

Figure 10:
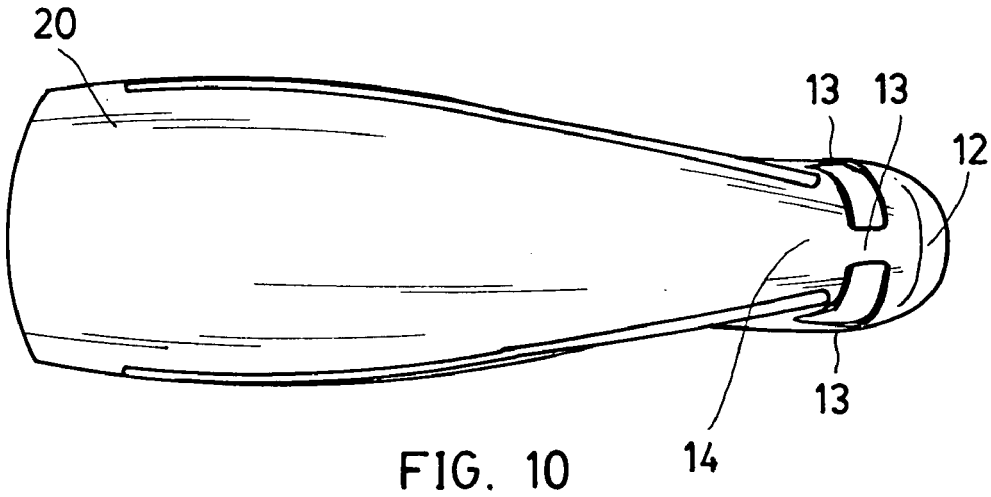
FIG. 10 is a side elevational view of FIG. 8.

Referring to FIG. 10, either connection member 13 of the second embodiment may comprise two parallel ones 13' with an oval shaped space formed therebetween. This is another improvement for the purposes of aesthetic and fitting different individuals with various foot sizes.

Note that it is possible of having two left connection members and two right connection members. Alternatively, it is possible of having two bottom connection members. Further, the shape of the connection member is not limited to the one shown in the above embodiments. All of these fall within the scope of the invention as long as the formed fin is adapted to fit different individuals with various foot sizes.

Figure 11:
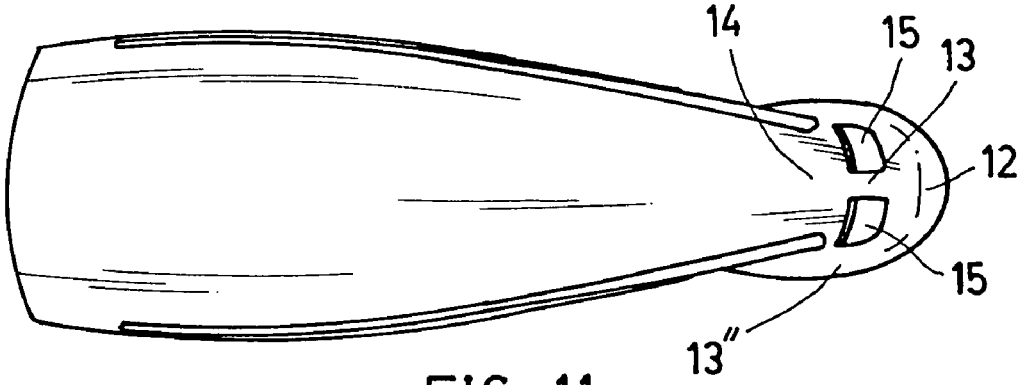
FIG. 11 is a bottom view of a third preferred embodiment of fin according to the invention.
Figure 12:
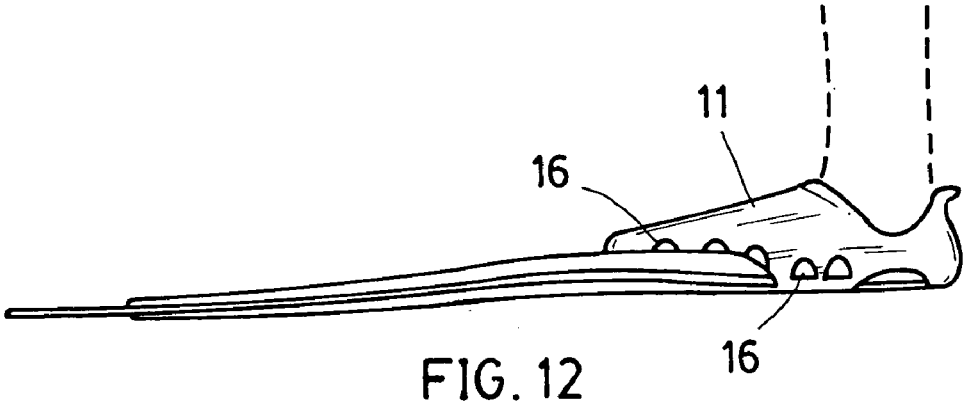
FIG. 12 is a side elevational view of FIG. 11.

Referring to FIGS. 11 and 12, a third preferred embodiment of the invention is shown. The third preferred embodiment substantially has same structure as the first preferred embodiment. The characteristics of the third preferred embodiment are detailed below. A connection member 13 is formed between the sole 14 and outside counter 12. Two large openings 15 are formed at two sides of the connection member 13. The connection member 13 is also adapted to stretch. Moreover, a plurality of holes 16 are formed at either side of the vamp 11. Thus, the vamp 11 is adapted to stretch. The fin of this embodiment can fit different individuals with various foot sizes.

Figure 13:
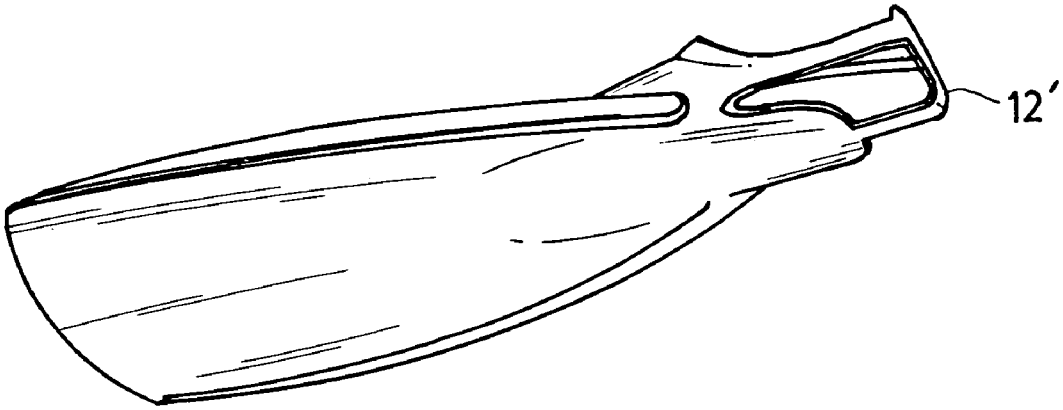
FIG. 13 is a perspective view of a fourth preferred embodiment of fin according to the invention.

Referring to FIG. 13, a fourth preferred embodiment of the invention is shown. The characteristic of the fourth preferred embodiment is that a U-shaped lightweight strap 12' is formed as a replacement of the outside counter.

While the invention herein disclosed has been described by means of specific embodiments, numerous modifications and variations could be made thereto by those skilled in the art without departing from the scope and spirit of the invention set forth in the claims.

What is claimed is:

1. A fin comprising:

a foot pocket including a front vamp for receiving a front portion of the human foot, an outside counter for receiving a rear portion of the human foot, and a plurality of stretchable connection members interconnected the vamp and the outside counter, wherein the stretchable connection members surround openings located between the vamp and the outside counter; and a blade extended forward from the vamp;

wherein the connection members are integrally formed with the foot pocket and the outside counter, the connection members being adapted to stretch when the human foot is inserted in the foot pocket so as to fit different individuals with various foot sizes.

2. The fin of claim 1, wherein the connection members are formed at both sides of the foot pocket for interconnecting the vamp and the outside counter.

3. The fin of claim 2, wherein at least two of the openings are elongated openings configured to elongate further when the foot is placed in the foot pocket.

4. The fin of claim 1, wherein some of the connection members are formed at both sides of the foot pocket for interconnecting the vamp and the outside counter and each of a remaining at least one of connection members is formed between a sole and the outside counter for interconnection.

5. The fin of claim 4, wherein each of the connection members formed at both sides of the foot pocket comprises at least one component.

6. The fin of claim 1, wherein the connection members are formed at both sides of the foot pocket for interconnecting the vamp and the outside counter, and wherein each of the connection members comprises at least one component.

7. The fin of claim 1, wherein the vamp comprises a plurality of holes.

8. The fin of claim 1, wherein the outside counter is shaped as a U-shaped strap.

* * * * *